US006811874B2

(12) United States Patent
Tanaka et al.

(10) Patent No.: US 6,811,874 B2
(45) Date of Patent: Nov. 2, 2004

(54) COMPOSITE FIBER

(75) Inventors: Kazuhiko Tanaka, Okayama (JP); Masao Kawamoto, Okayama (JP); Hitoshi Nakatsuka, Okayama (JP); Nobuhiro Koga, Okayama (JP); Ichirou Inoue, Okayama (JP); Tateki Yamakawa, Okayama (JP)

(73) Assignee: Kuraray Co., Ltd., Kurashiki (JP)

( * ) Notice: Subject to any disclaimer, the term of this patent is extended or adjusted under 35 U.S.C. 154(b) by 30 days.

(21) Appl. No.: 10/344,418

(22) PCT Filed: Jun. 5, 2002

(86) PCT No.: PCT/JP02/05544

§ 371 (c)(1),
(2), (4) Date: Aug. 13, 2003

(87) PCT Pub. No.: WO02/103095

PCT Pub. Date: Dec. 27, 2002

(65) Prior Publication Data

US 2004/0038028 A1 Feb. 26, 2004

(30) Foreign Application Priority Data

| | | |
|---|---|---|
| Jun. 15, 2001 | (JP) | 2001-181498 |
| Sep. 5, 2001 | (JP) | 2001-268275 |
| Sep. 19, 2001 | (JP) | 2001-284624 |

(51) Int. Cl.[7] ..... D01F 8/00
(52) U.S. Cl. ..... 428/370; 428/373; 428/374
(58) Field of Search ..... 428/370, 373, 428/374

(56) References Cited

U.S. PATENT DOCUMENTS

| | | | | |
|---|---|---|---|---|
| 6,004,673 A | * | 12/1999 | Nishijima | 428/373 |
| 6,228,490 B1 | * | 5/2001 | Nagano et al. | 428/370 |
| 6,495,255 B2 | * | 12/2002 | Tsutsui et al. | 428/370 |
| 6,617,023 B2 | * | 9/2003 | Tsutsui et al. | 428/370 |

FOREIGN PATENT DOCUMENTS

| | | |
|---|---|---|
| JP | 48-80820 | 10/1973 |
| JP | 54-101948 | 8/1979 |
| JP | 55-1379 | 1/1980 |
| JP | 60-21909 | 2/1985 |
| JP | 1-132811 | 5/1989 |
| JP | 5-239717 | 9/1993 |
| JP | 7-48716 | 2/1995 |
| JP | 7-126922 | 5/1995 |
| JP | 2000-129538 | 5/2000 |
| JP | 2001-115336 | 4/2001 |

* cited by examiner

*Primary Examiner*—N. Edwards
(74) *Attorney, Agent, or Firm*—Oblon, Spivak, McClelland, Maier & Neustadt, P.C.

(57) ABSTRACT

A core/sheath conjugate fiber comprises a sheath component B of an ethylene-vinyl alcohol copolymer and a core component A of a different thermoplastic polymer. In its cross section, the core component A has at least 10 projections or exists as an aligned group of at least 10 flattened cross-section core components, the distance (I) between the neighboring projections or between the neighboring flattened cross-section core components is at most 1.5 $\mu$m, the projections or the flattened cross-section core components are so positioned that their major axes are all at an angle of 90°±15° to the outer periphery of the fiber cross section, and the ratio (X) of the outer peripheral length ($L_2$) of the core component A to the outer peripheral length ($L_1$) of the conjugate fiber satisfies the following formula (1):

$$X/C \geqq 2 \quad (1)$$

wherein X indicates the ratio of the outer peripheral length of the core component A to the outer peripheral length of the conjugate fiber ($L_2/L_1$); and C indicates the conjugate ratio by mass of the core component A to the overall conjugate fiber defined as 1.

6 Claims, 4 Drawing Sheets

COMPOSITE FIBER

TECHNICAL FIELD

The present invention relates to a conjugate fiber of good workability, resistance to core/sheath peeling and deep colorability to give dyed articles.

BACKGROUND ART

In general, polyolefin resins such as polypropylene and polyethylene are relatively inexpensive and have good mechanical properties, and they are widely used in the field of fibers as well.

In view of their dyeability and heat resistance, however, their applications are limited and, for example, they are used mainly for non-clothing. For improving the dyeability of polyolefin fibers, known is a method of kneading pigment in them, but it is problematic in that the productivity is low and the quality of the resulting fibers is worsened to a great extent.

On the other hand, polyester resins such as polyethylene terephthalate and polybutylene terephthalate have good dyeability and heat resistance, and polyamides have good physical properties, and they are widely used in the field of fibers as well. However, they are problematic in that their specific gravity is large.

In addition, since polyolefin fibers and polyester fibers are hydrophobic, they have another drawback in that their water absorbability and moisture absorbability are not good. To overcome these drawbacks, various investigations have heretofore been made. For example, one method tried for that purpose comprises conjugate-spinning of a hydrophobic polymer such as polyester and a polymer having a hydroxyl group to thereby make the hydrophobic fibers have additional properties of hydrophilicity, etc.

Concretely, conjugate fibers of a hydrophobic thermoplastic resin such as polyester, polypropylene, polyamide or the like, and an ethylene-vinyl alcohol copolymer are disclosed in JP-B 56-5846, 55-1372, etc.

In the above-mentioned conjugate fibers, however, the adhesion of the conjugated two polymers is low at their interface and therefore the two components readily peel from each other, and this is a trouble in some use. In particular, when the fibers are worked, for example, for hard twisting or false twisting under tension applied thereto perpendicularly to the machine direction of the fibers, the conjugated components of the fibers may often peel from each other somewhere in the thus-worked fibers. If the hard-twisted or false-twisted yarns are formed into fabric and the resulting fabric is colored, the peeled part of the fibers is seen whitish and it loses the commercial value of the fabric.

An object of the invention is to provide a conjugate fiber of at least two thermoplastic resin components, which has improved workability, resistance to core/sheath peeling and deep colorability to give colored articles, not detracting from the characteristics intrinsic to these resins.

Another object is to provide a conjugate fiber which has good colorability into more vivid colors and is glossy, and further has good moisture absorbability, still keeping the above-mentioned good workability and resistance to peeling between the conjugated components.

DISCLOSURE OF THE INVENTION

Specifically, the invention is a core/sheath conjugate fiber which comprises a core component A of a thermoplastic polymer and a sheath component B of another thermoplastic polymer and which is characterized in that, in its cross section, the core component A has at least 10 projections or exists as an aligned group of at least 10 flattened cross-section core components, the distance (I) between the neighboring projections or between the neighboring flattened cross-section core components is at most 1.5 $\mu$m, the projections or the flattened cross-section core components are so positioned that their major axes are all at an angle (R°) of 90°±15° to the outer periphery of the fiber cross section, and the ratio (X) of the outer peripheral length ($L_2$) of the core component A to the outer peripheral length ($L_1$) of the conjugate fiber satisfies the following formula (1):

$$X/C \geqq 2 \quad (1)$$

wherein X indicates the ratio of the outer peripheral length of the core component A to the outer peripheral length of the conjugate fiber ($L_2/L_1$); and C indicates the conjugate ratio by mass of the core component A to the overall conjugate fiber defined as 1.

BEST MODES OF CARRYING OUT THE INVENTION

Figure 1:
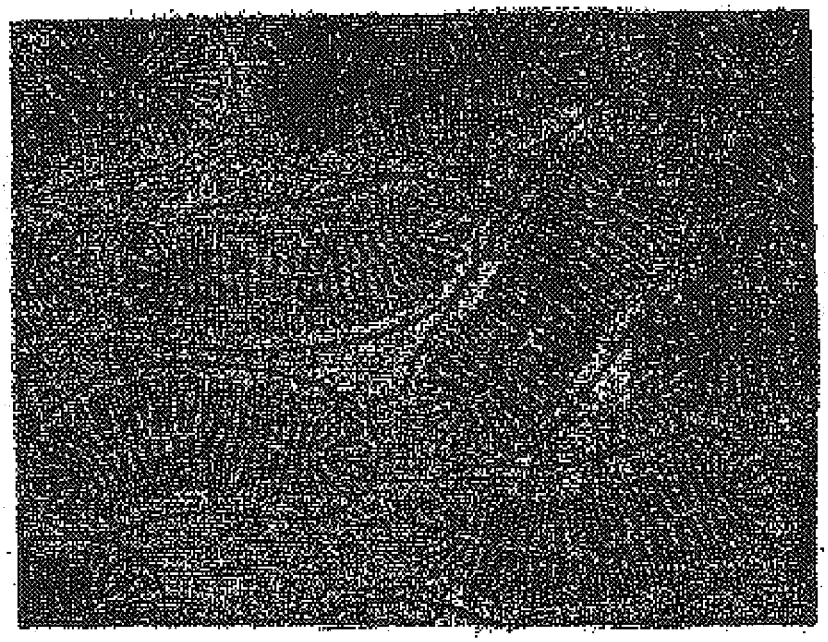
FIG. 1 is a photograph that shows the conjugated cross sections of one embodiment of the fibers of the invention.

The thermoplastic polymer to be used for the core component A that forms the conjugate fiber of the invention includes, for example, polyolefin resins such as polyethylene (SP value=7.9), polypropylene (SP value=8.1), polymethylpentene (SP value=8.0): polyester resins such as polyethylene terephthalate (SP value=10.7), polybutylene terephthalate (SP value=10.8), polytrimethylene terephthalate (SP value=12.1), polyhexamethylene terephthalate (SP value=10.0), polylactic acid (SP value=9.5); polyamide resins such as nylon 6 (SP value=12.7), nylon 66 (SP value=13.6); acrylic acid-based resins (SP value=8.7 to 9.5), vinyl acetate-based resins (SP value=9.4to 12.6), dienic resins (SP value=7.4to 9.4), polyurethane resins (SP value=10.0), polycarbonate resins (SP value=9.8 to 10.0), polyarylates (SP value=9.2), polyphenylene sulfides (SP value=12.5), polyether-ester ketones (SP value=10.4 to 11.3), fluororesins (SP value=6.2 to 6.5), and semiaromatic polyester-amides (SP value=11.9). Not detracting from the advantages of the invention, these thermoplastic polymers may contain inorganic substances such as titanium oxide, silica, barium oxide; colorants such as carbon black, dye, pigment; and other various additives such as antioxidant, UV absorbent, light stabilizer.

On the other hand, another thermoplastic polymer for the sheath component B is a polymer that is essentially immiscible with the core component A. For it, for example, usable are polymers of polyolefin resins, polyester resins, polyamid resins, acrylic acid-based resins, vinyl acetate-based resins, dienic resins, polyurethane resins, polycarbonat resins, polyarylates, polyphenylene sulfides, polyether-ester ketones, fluororesins, semiaromatic polyester-amides, ethylene-vinyl alcohol copolymers, etc.

Like the core component A, the sheath component B may also contain inorganic substances such as titanium oxide, silica, barium oxide, colorants such as carbon black, dye, pigment, and other various additives such as antioxidant, UV absorbent, light stabilizer, not detracting from the advantages of the invention.

In the invention, the combination of the core component A and the sheath component B to constitute the core/sheath conjugate fiber is not specifically defined. Even though the thermoplastic polymers for the two components are so combined that the difference therebetween in the SP value (solubility parameter) could be, for example, at least 0.5, but preferably at least 1.0, more preferably at least 1.8, the combination obviously exhibits the effect of improving the resistance to core/shell peeling so far as the interfacial structure of the conjugated components is defined to have the specific profile as in the invention.

The SP value referred to herein is calculated, for example, according to the method proposed by P. A. J. Small [P. A. J. Small; *J. Appl. Chem.*, 3, 71 (1953)].

In the invention, an ethyl n-vinyl alcohol copolymer is preferably used for the sheath component B for making the conjugate fiber have good hydrophilicity, natural fiber-lik good feel, good colorability and good glossiness.

The ethylene-vinyl alcohol copolymer may be obtained through saponification of an ethylene-vinyl acetate copolymer. Preferably, it has a high degree of saponification of at least 95%, and its degree of copolymerization with ethylene may be from 25 to 70 mol % or that is, the vinyl alcohol component of the copolymer (including the non-saponified vinyl acetate component and acetalized vinyl alcohol component) may be from about 30 to 75 mol %.

In case where the ratio of the vinyl alcohol component of the polymer lowers, the characteristics such as hydrophilicity of the polymer will worsen owing to the decrease in the hydroxyl group and the intended fiber having a natural fiber-like feel of good hydrophilicity could not be obtained. Contrary to this, when the ratio of the vinyl alcohol component increases too much, the melt-moldability of the polymer will worsen and, in addition, the spinnability thereof will also worsen in conjugate-spinning of the polymer along with the core component A, and, while spun or drawn, the fiber will be much broken or cut.

Accordingly, the copolymer having a high degree of saponification and a degree of copolymerization with ethylene of from 25 to 70 mol % is suitable for obtaining the intended fiber for the invention.

In case where a high-melting-point polymer such as polyester is used for the cor component A which is to be conjugated with the sheath component B, it is desirable that the heat resistance of the sheath component B in melt molding is improved for long-run stable spinning. For that means, it is effective to define the ratio of copolymerization with ethylene in the copolymer within a suitable range and further to control the metal ion content of the polymer so as not to be higher than a predetermined level.

The mechanism of pyrolysis of the sheath component B may principally include crosslinking of the backbone chain of the polymer to give gels and breakage and cleavage of the backbone chain and the side branches to result in the polymer degradation as combined. In case where the metal ions are removed from the sheath component B, the thermal stability of the polymer in melt spinning remarkably increases. In particular, when the content of the Group I alkali metal ions such as $Na^+$ and $K^+$ ions and that of the Group II alkaline earth metal ions such as $Ca^{2+}$ and $Mg^{2+}$ ions are limited to at most 100 ppm each, it is remarkably effective.

Especially in long-run melt spinning at high temperatures, when gels are formed in the sheath component B, they will gradually deposit on the spinning filter to clog the filter pores, and, as a result, the spinning pack pressure suddenly increases and the nozzle life is ther by shortened and, in addition, the fiber will be frequently broken or cut while spun. If more gels deposit, they will clog the polymer lines to cause spinning trouble, and it is undesirable.

In case where the Group I alkali metal ions and Group II alkaline earth metal ions are removed from the sheath component B, the trouble to be caused by the formation of gels may be prevented in melt spinning at high temperatures, especially even in long-run melt spinning at 250° C. or higher.

Accordingly, the content of these metal ions is preferably at most 50 ppm each, more preferably at most 10 ppm each.

One example of producing the ethylene-vinyl alcohol copolymer is described. Ethylene is polymerized with vinyl acetate in a mode of radical polymerization in a polymerization solvent such as methanol in the presence of a radical polymerization catalyst, then the non-reacted monomers are purged out, the resulting polymer is saponified with sodium hydroxide to give an ethylene-vinyl alcohol copolymer, the copolymer is pelletized in water, and the resulting pellets are washed with water and dried. As in the process of producing the polymer, alkali metal and alkaline earth metal are inevitably in the polymer produced. In general, the polymer is contaminated with at least hundreds ppm of alkali metal and alkaline earth metal.

One method for reducing as much as possible the content of alkali metal ions and alkaline earth metal ions in the polymer comprises washing the wet pellets that were saponified and pelletized in the polymer production process, with a large quantity of pure water that contains acetic acid followed by further washing them with a larger excess quantity of pure water alone.

The sheath component B is produced by saponifying a copolymer of ethylene and vinyl acetate with sodium hydroxide, and its degree of saponification is preferably at least 95%. If the degree of saponification is low, the polymer crystallinity lowers, and, as a result, not only the physical properties such as strength of the fibers produced will lower but also the sheath component B will come to readily soften to cause some trouble in the process of working the fibers. Moreover, the feel of the fibrous structures obtained Is not good, and it is therefore unfavorable.

In case where such an ethylene-vinyl alcohol copolymer is used for the sheath component B in the invention, the polymer for the core component A is preferably a thermoplastic polymer having a melting point of not lower than 160° C., preferably not lower than 180° C. For it, for example, preferred are polyamides such as typically nylon 12, nylon 6, nylon 66; polyolefins such as typically polypropylene; and polyesters such as typically polyethylene terephthalate, polybutylene terephthalate, polytrimethylene terephthalate. Also usable for it are polyesters such as polyhexamethylene terephthalate and polylactic acid.

In particular, in polyalkylene terephthalate-type polyesters, a part of the terephthalic acid component may be substituted with any other dicarboxylic acid component, and the diol component may also be substituted with a small amount of any other diol component except the principal diol component.

The other dicarboxylic acid component except terephthalic acid includes, for example, isophthalic acid, naphthalenedicarboxylic acid, diphenyldicarboxylic acid, diphenoxydiethanedicarboxylic acid, β-hydroxyethoxybenzoic acid, p-hydroxybenzoic acid, adipic acid, sebasic acid, 1,4-cyclohexanedicarboxylic acid, etc.

The diol component includes, for example, ethylene glycol, trimethylene glycol, tetramethylene glycol, hexamethylene glycol, diethylene glycol, neopentyl glycol cyclohexane-1,4-dimethanol, polyethylene glycol, polytetramethylene glycol, bisphenol A, bisphenol S, etc.

In particular, it is desirable that the core component A is copolymerized with a compound of the following general formula (i) for better core/sheath peeling resistance.

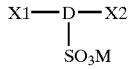

(i)

wherein D represents a trivalent aromatic group or a trivalent aliphatic group; X1 and X2 each represent an ester-forming functional group or a hydrogen atom, and they may be the same or different; and M represents any of an alkali metal, an alkaline earth metal or an alkylphosphonium group.

In the compound (i) that serves as a copolymerizing component for the core component A, D is preferably a trivalent aromatic group in view of the heat resistance of the compound in polymerization. For example, it includes a benzenetriyl group such as a 1,3,5-benzenetriyl, 1,2,3-benzenetriyl or 1,3,4-benzenetriyl group; and a naphthalenetriyl group such as a 1,3,6-naphthalenetriyl, 1,3,7-naphthalenetriyl, 1,4,5-naphthalenetriyl or 1,4,6-naphthalenetriyl group.

M is an alkali metal atom such as sodium, potassium or lithium; an alkaline earth metal atom such as calcium or magnesium; or an alkylphosphonium group such as a tetra-n-butylphosphonium, butyltriphenylphosphonium or ethylbutylphosphonium group.

X1 and X2 each are an ester-forming functional group or a hydrogen atom, and they may be the same or different. For these, preferred is an ester-forming functional group, since the compound is copolymerized in the backbone chain of the polymer. Specific examples of the ester-forming functional group are mentioned below.

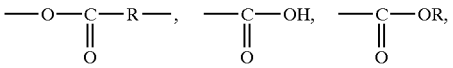

wherein R represents a lower alkyl group or a phenyl group; a and d each are an integer of at least 1; and b is an integer of at least 2.

Specific examples of the compound (i) are 5-sodium sulfoisophthalate, 5-potassium sulfoisophthalate, 5-tetrabutylphosphonium sulfoisophthalate, tetrabutylphosphonium 2,6-dicarboxynaphthalene-4-sulfonate, and α-tetrabutylphosphonium sulfosuccinate. Above all, preferred is 5-sodium sulfoisophthalate in view of the cost performance.

Preferably, the degree of copolymerization with the compound (i) falls within a range of from 0.5 to 5 mol % of the overall acid component that constitutes the polyester for the core component A. If the degree is smaller than 0.5 mol %, the dyeability of the fibers produced will be poor; but if larger than 5 mol %, the fibers are difficult to produce and, in particular, the fibers are difficult to spin and draw, and, in addition, the strength of the fibers produced will be low, though the fibers could be colored vividly. More preferably, the degree of copolymerization falls between 1 and 3 mol %. Not detracting from the spinning processability thereof into fibers, the core component A may contain additives such as antioxidant, UV absorbent, pigment, etc.

Next described in detail is the profile of the conjugate cross section of the fiber of the invention.

One embodiment of the cross section profile of the conjugate fiber of the invention is in the photograph of FIG. 1 that shows the cross section of the fibers. As seen in this, the core component A must have at least 10 projections aligned like folds in the interface between the core component A and the sheath component B, and the number of the thus-formed projections is preferably at least 15, more preferably at least 25. If the number of the projections decreases, the interface peeling resistance of the conjugated components will be unsatisfactory and, as the case may be, the distance between the neighboring projections could not be at most 1.5 μm and the fibers could not be colored deeply.

Figure 2:
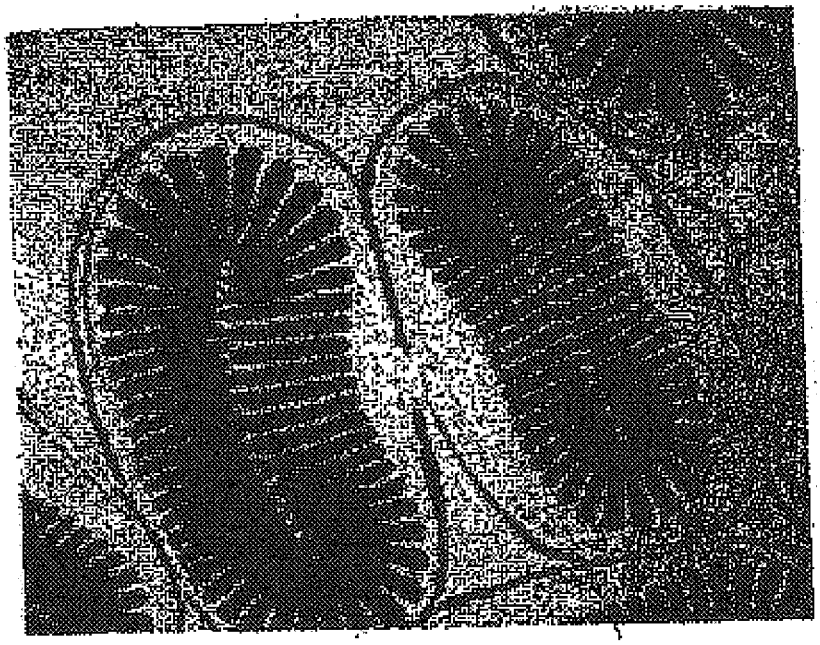
FIG. 2 is a photograph that shows the conjugated cross sections of another embodiment of the fibers of the invention.

Another embodiment of the conjugate fiber of the invention is in the photograph of FIG. 2 that shows the cross section of the fibers. As seen in this, it is a matter of importance that the core component A is so designed that at least 10 independent flattened cross sections thereof are aligned to make the major sides thereof adjacent to each other. Preferably, the number of the flattened cross-section core components A is at least 15, more preferably at least 25, and these are aligned in the cross section of the fiber. If the number of the core components A each having such a flattened cross-section profile decreases, the fibers may lose the interface peeling resistance between the conjugated components, and, as the case may be, the distance be tween the neighboring projections could not be at most 1.5 μm and the fibers could not be colored deeply.

Having the configuration as in FIG. 1 or 2 in which the projections or the flattened cross-section core components are specifically aligned, the fibers are satisfactory in the interface peeling resistance to external force in every direction.

In the fiber cross section of FIG. 2, the profile of the individual core components A is preferably so flattened that the longest major diameter (L)/shortest minor diameter (D) is at least 1.5, more preferably at least 2.

In any embodiment of the conjugated profile in the invention as in FIG. 1 and FIG. 2, it is important that the distance (I) between the neighboring folded projections of the component A or between the neighboring flattened cross-section core components is at most 1.5 μm, and that the projections or the flattened cross-section core components are so positioned that their major axes are all at an angle of 90°±15° to the outer periphery of the fiber cross section. If the distance (I) between the neighboring projections of the component A or between the neighboring flattened cross-section core components is over 1.5 μm, the fibers could not be colored satisfactorily deeply and uniformly. In addition, when the projections or the flattened cross-section core components are so aligned that their major axes prolonged toward the outer periphery of the fiber cross section meet that outer periphery at an angle (R) of smaller then 75° or larger than 105°, the core component A readily peels from the component B at their interface owing to the external force applied to the fiber, and, as a result, the colored articles of the fibers will be whitened, and this is unfavorable.

From the above-mentioned points, it is desirable in the invention that the distance (I) between the neighboring projections or between the neighboring flattened cross-section core components is at most 1.2 μm, and that the projections or the flattened cross-section core components are so positioned that their major axes are all at an angle of 90°±10° to the outer periphery of the fiber cross section.

The distance (I) between the neighboring projections or between the neighboring flattened cross-section core components as referred to herein is meant to indicate the mean distance between the tips of the neighboring projections or between the tips in the major-axis direction (that is, the tips nearer to the outer periphery of the fiber) of the neighboring flattened cross-section core components. Not detracting from the advantages of the invention, however, the distance between some neighboring ones of the large number of the projections or the core components that are in the cross section of the fiber may be partly over 1.5 μm with no trouble.

Another more important matter in the invention is that the ratio for the outer peripheral length ($L_2$) of the core component A to the outer peripheral length ($L_1$) of the conjugate fiber satisfies the following formula (1):

$$2 \leq X/C \quad (1)$$

wherein X indicates the ratio of the outer peripheral length of the core component A to the outer peripheral length of the conjugate fiber ($L_2/L_1$); and C indicates the conjugate ratio by mass of the core component A to the overall conjugate fiber defined as 1.

The ratio X of the outer peripheral length ($L_2$) of the core component A to the outer peripheral length ($L_1$) of the conjugate fiber varies depending on the conjugate ratio of the core component A. X/C is at least 2, preferably at least 2.5, more preferably at least 3, even more preferably at least 5. If X/C is smaller than 2, it is unfavorable since the interface peeling resistance of the fiber is not so good.

Though not overstepping the level of inference at least at present, the function and the mechanism of the interface peeling resistance in the invention will be probably because of the synergism of the increase in the adhesive area of the conjugated components combined with the anchor effect of the projections formed by the component A.

Preferably, the conjugate ratio of the sheath component B to the core component A falls between 90:10 and 10:90 (by mass), more preferably between 70:30 and 30:70. It may be suitably defined depending on the conjugate configuration of the components and on the cross section profile of the fiber.

If the conjugate ratio of the sheath component B is smaller than 10% by mass, the core component A will be exposed out on the surface and the quality of the fiber will lower, and, in addition, the fiber will lose the polymer characteristics of the sheath component B. On the other hand, if the conjugate ratio of the sheath component B is over 90% by mass, it is unfavorable since the conjugate fiber will lose the polymer characteristics of the core component A.

In the invention, for example, when an easily dyeable polymer is used for the core component A, the distance between the projections of the core component A is at most 1.5 μm and is small and the projections are formed of such an easily dyeable polymer, and when an ethylene-vinyl alcohol copolymer of low refraction is used for the sheath component B, then the fibers of the type can be dyed vividly and deeply.

In case where such fibers are used for sports clothes and the like, they must be high colorable and also glossy. In general, glossy fibers are poorly colorable, but on the contrary, fibers of good colorability could be hardly glossy. As opposed to this, the invention has realized conjugate fibers that satisfy both vivid colorability and good glossiness by specifically defining the constitutive components and the cross-section profile of the fibers. For better glossiness, fibers having a broader area of a flat face on which light well reflects ar better, and fibers of which the cross section has a mild degree of modification and has a broad flat face are more effective. For the cross section of this type, fibers having a triangular or flattened cross section are the best.

In the invention, the fineness of the conjugate fiber is not specifically defined, and may be any desired one. However, for better colorability, glossiness and feel thereof, the single fiber fineness of the conjugate fiber preferably falls between 0.3 and 11 dtex or so. Not only continuous fibers but also cut fibers are expected to enjoy the advantages of the invention.

The method for producing the conjugate fiber of the invention is not specifically defined so far as it produces the intended conjugate fiber that satisfies the requirements of the invention. For example, a conjugate spinning apparatus is used, and a conjugated flow of a polymer for the sheath component B and a polymer for the core component A is led into an inlet of a nozzle. In this stage, the polymer for the core component A is made to flow through a distribution plate which has, on its circumference, the same number of pores as that of the projections of the core component A, and, while the overall flow of the core component A that flows through the respective pores is covered with the polymer of the sheath component B, the resulting conjugate flow is led toward the center of the inlet of the nozzle, and this is spun out in melt through the spinning nozzle to obtain th intended conjugat fiber. In this process, when the distribution plate used is holed to have a center pore, the conjugated cross section of the fiber obtained is as in FIG. 2; but when it is not holed, the conjugate cross section of the fiber obtained is as in FIG. 1.

For spinning and drawing the fiber, any method is employable. For example, after the fiber has been spun at low speed or medium speed, it may be drawn; or the fiber may be spun and drawn at the same time at high speed; or after the fiber has been spun, it may be drawn and false-twisted simultaneously or successively.

Preferably in the invention, the core component A contain inorganic particles. The primary mean particle size of the inorganic particles is preferably from 0.01 to 5.0 μm, more preferably from 0.03 to 3.0 μm. If the primary mean particle size of the inorganic particles is smaller than 0.01 μm, the conjugate fiber may be looped or fluffed or its fineness may fluctuate even when the temperature in the heating zone in which the fiber is drawn, as well as the fiber traveling speed and the tension applied to the traveling fiber may fluctuate only slightly. On the other hand, if the primary mean particle size of the inorganic particles is over 3.0 μm, the conjugate fiber will be difficult to draw, and the fiber productivity will lower, and, as the case may be, the fiber may be out during production. The primary mean particle size of inorganic particles as referred to wherein is measured through centrifugal precipitation.

The content of the inorganic particles preferably falls between 0.05 and 10.0% by mass, more preferably between 0.3 and 5.0% by mass, based on the weight of the core component A. If the content of the inorganic particles is smaller than 0.1% by mass, the conjugate fiber may be looped or fluffed or its fineness may fluctuate even when the temperature in the heating zone in which the fiber is drawn, as well as the fiber traveling speed and the tension applied to the traveling fiber may fluctuate only slightly. On the other hand, if the content of the inorganic particles is over 10.0% by mass, the inorganic particles will increase the resistance between the traveling fiber and air in the fiber drawing step and, as a result, the fiber may be fluffed or cut, and the process of fiber production will be unstable.

Further in the invention, it is desirable that the product (Y) of the primary mean particle size ($\mu$m) of the inorganic particles in the core component A and the content (% by mass) thereof in the polymer satisfies $0.01 \leqq Y \leqq 3.0$. If the product Y is smaller than 0.01, the conjugate fiber may be looped or fluffed or its fineness may fluctuate, and the fiber productivity may lower and is not good, and, in addition, the fiber could not be drawn In many portions thereof and will be therefore unsuitable to clothing. If the product Y is over 3.0, the fiber may be much fluffed and cut during production, and its productivity will be low.

Th inorganic particles for use herein are not specifically defined in point of their type, and may be any ones that are stable by themselves and do not worsen the fiber-forming polyester. Typical examples of the inorganic particles effectively usable In the invention are silica, alumina, calcium carbonate, titanium oxide, barium sulfate, etc. One and the same type or two or more different types of these inorganic particles may be used either alone or as combined. In case where two or more different types of such inorganic particles are combined for use herein, the sum of the products of the particle sizes (a1, a2, . . . an) of the respective inorganic particles and the content (b1, b2, . . . bn) thereof must satisfy the above-mentioned range. In other words, Y=a1×b1+a2×b2+. . . an×bn, and Y shall satisfies the above-mentioned range.

The method of adding the inorganic particles to the core component A is not specifically defined. Anyhow, the inorganic particles shall be uniformly mixed with the core component A in any stage before the step of melt-spinning the core component A. For example, the inorganic particles may be added thereto in any stage of polymerization to give the core component A, or may be added later to the pellets while they are produced after polycondensation, or may be added to the core component A so as to be uniformly melt-mixed with it before the component A is spun out through a spinneret.

The fibers of the invention obtained in the manner as above may be used as various fibrous bulk materials (fibrous structures). The fibrous bulk materials include not only woven or knitted fabrics or nonwoven fabrics of only the fibers of the invention but also woven or knitted fabrics or nonwoven fabrics partly comprising the fibers of the inventions for example, woven or knitted union fabrics with any other fibers such as natural fibers, chemical fibers, synthetic fibers and the like, as well as knitted or woven fabrics of combined or blended yarn, or blended nonwoven fabrics. Anyhow, it is desirable that the ratio of the fibers of the invention in the woven or knitted fabrics or the nonwoven fabrics is at least 10% by mass, more preferably at least 30% by mass.

The principal use of the fibers of the invention is described. Continupus fibers may be used alone or may be combined with any others in woven or knitted fabrics, and they have a good feel and may be materials for clothing. On the other hand, cut fibers may be for staple for clothing, and also for nonwoven fabrics by dry or wet process, and these are favorable not only for clothing but also for non-clothing such as for various living materials, industrial materials, etc.

EXAMPLES

The invention is described more concretely with reference to the following Examples, to which, however, the invention is not whats ever limited.

Intrinsic Viscosity of Polymer:

Polyester is dissolved in a 1/1 (by mass) mixed solvent of phenol and tetrachloroethane, and measured in a thermostat at 30° C., using an Ubbelohde's viscometer. Saponified ethylene-vinyl acetate copolymer is measured in 85% phenol at 30° C. or lower.

Color Vividness and Glossiness:

Ten panelists organoleptically evaluate samples of a fabric dyed under a predetermined dyeing condition. They give point 2 to excellent samples, point 1 to good samples and point 0 to bad samples.

○: The total point is at least 15.

Δ: The total point is from 8 to 14.

x: The total point is at most 7.

Adhesiveness of Polymers in Conjugate Fiber:

24 to 36 filaments are twisted to a count of from 500 to 1000 T/m. In that condition, the twisted strand is cut, and, using a 500-power electronic microscope, the cross section of each filament is observed for polymer peeling. Concretely, 10 cross sections are observed, and the sample is evaluated according to the criteria mentioned below.

○○: The peeling is smaller than 10%.

○: The peeling is from 10 to 20% or so.

Δ: Th peeling is from 20 to 50% or so.

x: The peeling is over 50%.

Fiber Strength: Measured according to JIS L1013.

Fiber Productivity: Evaluated on the basis of the number of fluffs and the frequency of fiber breakage per ton of fiber.

○○: The total of the number of fluffs and the frequency of fiber breakage is less than 1/ton.

○: The total of the number of fluffs and the frequency of fiber breakage is from 1 to less than 2/ton.

Δ: The total of the number of fluffs and the frequency of fiber breakage is from 2 to less than 5/ton.

x: It is at least 5/ton.

Colorability: Knitted sleeve fabric is dyed under the condition mentioned below, and its degree of dye absorption is evaluated.

| | |
|---|---|
| Foron Navy S2GL | 2% omf |
| Disper TL | 1 g/liter |
| Acetic acid (50%) | 1 cc/liter |
| Bath ratio | 1:50 |
| 120° C. × 40 minutes | |

Total Evaluation: From the total result of the fiber productivity, the interface peeling resistance and the colorability thereof, samples tested are evaluated according to the criteria mentioned below.

○○: This is in the rank of ○○ in every test.

○: This is in the rank of ○ in every test.

x, and Δ to x: This is in th worst rank of all the tests.

Example 1

Nylon 6 (SP value=12.7, Ube Kosan's 1013BK1) was used for the sheath component B; and polyethylene terephthalate (SP value=10.7, Kuraray's KS750RCT) was for the core component A. Conjugated in a ratio of 50:50 (by mass), the sheath component B and the core component A were spun in melt. The spinning temperature was 260° C., and the take-up speed was 3500 m/min. This gave conjugate filament yarn (83 dtex/24 filaments) having the cross-section profile as in FIG. 3. The number of projections of the core component A of this conjugate fiber was 50: and the mean distance between the neighboring projections was 0.35 $\mu$m. The ratio ($L_2/L_1$) of the outer peripheral length ($L_2$) of the core component A to the outer peripheral length ($L_1$) of the conjugate fiber was 4.5 (X/C=9.0): and the strength of the fiber was 4.0 N/dtex. Next, this was twisted to a count of 800 T/M, and knitted. The knitted fabric was dyed under the condition mentioned below, using an ordinary jet dyeing machine. Then, this was dried and finally set in an ordinary manner. The dyed fabric was good, vivid and glossy, and core-sheath interface peeling was not found at all In the fibers. The results are shown in Table 2.

Examples 2 to 7

Fibers were produced and evaluated for the interface peeling resistance, the colorability and the productivity thereof in the same manner as in Example 1, except that the type of the cor component A and that of the sheath component B were changed to thos shown in Table 1.

Example 8

Fibers were produced and evaluated for the interface peeling resistance, the colorability and the productivity thereof in the same manner as in Example 1, except that the conjugate ratio of the core component A to the sheath component B was changed as in Table 1.

Examples 9, 10

Fibers were produced and evaluated for the interface peeling resistance, the colorability and the productivity thereof in the same manner as in Example 1, except that their cross-section profiles were changed.

TABLE 1

Figure 3:
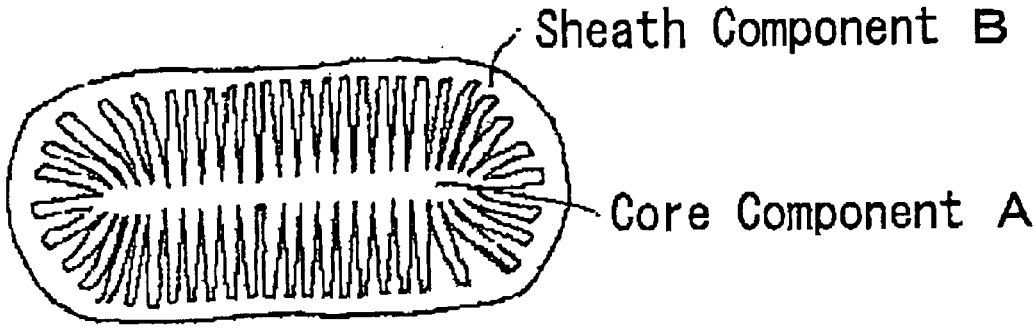
FIG. 3 is a schematic view showing one example of the conjugated cross section of the fiber of the invention.
Figure 4:
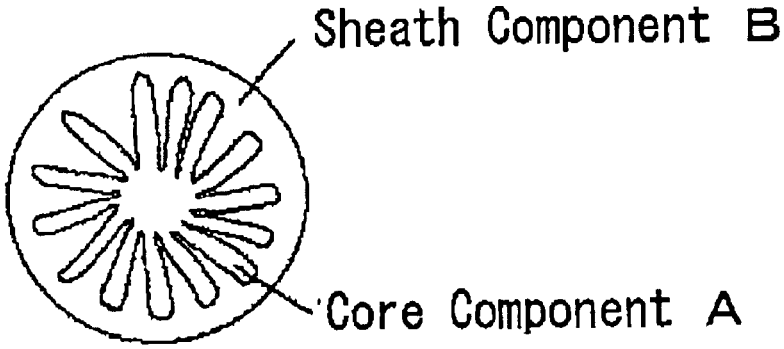
FIGS. 4 to 8 are schematic views showing other examples of the conjugated cross section of the fiber of the invention.
Figure 5:
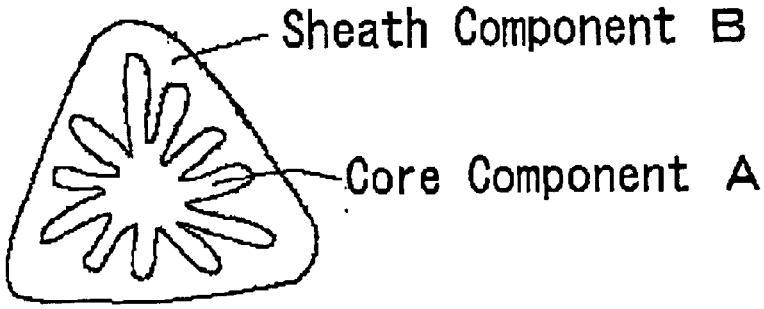

| | Sheath Component B | | Core Component A | | \|SP of A-SP of B\| | Conjugate Ratio (C) | Cross-Section Profile | Number of Projections | Distance between Neighboring Projections (I) | Angle (R°) | L2/L1 | (L2/L1)C | Degree of Flatness of Conjugate Fibers | Fiber Strength (cN/dtex) |
|---|---|---|---|---|---|---|---|---|---|---|---|---|---|---|
| | type | SP | type | SP | | | | | | | | | | |
| Example 1 | nylon 6 | 12.7 | PET | 10.7 | 2.0 | 0.5 | FIG. 3 | 50 | 0.35 | 80–90 | 4.5 | 9.0 | 2.3 | 4.0 |
| 2 | PE | 7.9 | PET | 10.7 | 3.6 | 0.5 | FIG. 3 | 50 | 0.33 | 80–90 | 4.7 | 9.4 | 2.0 | 3.2 |
| 3 | nylon 6 | 12.7 | PP | 8.1 | 4.6 | 0.5 | FIG. 3 | 50 | 0.4 | 80–90 | 4.7 | 9.4 | 2.4 | 3.5 |
| 4 | PET | 10.7 | PP | 8.1 | 2.6 | 0.5 | FIG. 3 | 30 | 0.68 | 80–90 | 3.3 | 6.6 | 2.2 | 3.7 |
| 5 | EVAL | 17.2 | nylon 6 | 12.7 | 4.5 | 0.5 | FIG. 3 | 30 | 0.61 | 80–90 | 3.2 | 6.4 | 2.1 | 3.6 |
| 6 | PEN | 12.6 | Vectra ® | 11.0 | 1.6 | 0.5 | FIG. 3 | 30 | 0.6 | 80–90 | 3.6 | 7.2 | 1.9 | 6.5 |
| 7 | PPS | 12.5 | Vectra ® | 11.0 | 1.6 | 0.5 | FIG. 4 | 10 | 2.1 | 80–90 | 1.2 | 2.4 | 1.1 | 6.4 |
| 8 | nylon 6 | 12.7 | PET | 10.7 | 2.0 | 0.3 | FIG. 3 | 30 | 0.48 | 80–90 | 2.4 | 8.0 | 2.0 | 3.7 |
| 9 | nylon 6 | 12.7 | PET | 10.7 | 2.0 | 0.3 | FIG. 4 | 30 | 0.73 | 80–90 | 2.8 | 5.6 | 1.1 | 3.8 |
| 10 | nylon 6 | 12.7 | PET | 10.7 | 2.0 | 0.5 | FIG. 5 | 30 | 0.7 | 75–90 | 1.5 | 3.0 | — | 3.8 |
| Comp. Example 1 | nylon 6 | 12.7 | PET | 10.7 | 2.0 | 0.5 | FIG. 9 | 0 | — | — | 0.46 | 0.92 | — | 4.1 |
| 2 | PE | 7.9 | PET | 10.7 | 2.8 | 0.5 | FIG. 9 | 0 | — | — | 0.39 | 0.78 | — | 3.5 |
| 3 | PE | 7.9 | PET | 10.7 | 2.8 | 0.5 | FIG. 9 | 3 | 12.7 | 80–90 | 0.60 | 1.2 | — | 3.3 |

PE: polyethylene.
PP: polypropylene
PET: polyethylene terephthalate,
EVAL: ethylene vinyl arcohol
Vectra ®: polyarylate of 70 mol% p-hydroxybenzoic acid (HBA) and 30 mol% of p-hydroxynaphthoic acid

TABLE 2

| | Evaluation Results | | | |
|---|---|---|---|---|
| | Fiber Productivity | Interface Peeling Resistance | Colorability | Total Evaluation |
| Example 1 | ○○ | ○○ | Vivid and glossy | ○○ |
| 2 | ○ | ○○ | " | ○ to ○○ |
| 3 | ○ | ○○ | " | ○ to ○○ |
| 4 | ○ | ○ to ○○ | " | ○ to ○○ |
| 5 | ○ | ○ to ○○ | " | ○ to ○○ |
| 6 | ○ | ○ | " | ○ |
| 7 | ○ | ○ | " | ○ |
| 8 | ○ | ○○ | " | ○ to ○○ |
| 9 | ○ | ○○ | " | ○ to ○○ |
| 10 | ○ | ○○ | " | ○ to ○○ |
| Comp. Example 1 | ○ | Δ to x | Vivid, but many friction marks seen owing to the interface peeling in the fibers. This is unsuitable to outer wear. | Δ to x |
| 2 | ○ | x | Vivid, but many friction marks seen owing to the interface peeling in the fibers. This is unsuitable to outer wear. | x |
| 3 | ○ | Δ to x | Vivid, but many friction marks seen owing to the interface peeling in the fibers. This is unsuitable to outer wear. | Δ to x |

Comparative Example 1

Fibers were produced in the same manner as in Example 1, except that the cross-section profile and the number of projections of the core component A thereof were changed as in Table 1. Many friction marks were seen in the fabric owing to the core/sheath interface peeling in the fibers. The quality of the fabric is low and is not on the practical level.

Comparative Examples 2, 3

Fibers were produced in the same manner as in Example 1, except that the polymers for them and the cross-section profile and the number of projections of the core component A thereof were changed as in Table 1. Many friction marks were seen in the fabric owing to the core/sheath interface peeling in the fibers. The quality of the fabric is low and is not on the practical level.

Example 11

Ethylene was polymerized with vinyl acetate in a mode of radical polymerization at 60° C. in a polymerization solvent of methanol to prepare a random copolymer having a degree of copolymerization with ethylene of 44 mol %. Next, this was saponified with sodium hydroxide to be a saponified ethylene-vinyl acetate copolymer having a degree of saponification of at least 99%. While still wet, the polymer was repeatedly washed with a large excess amount of pure water containing a small amount of acetic acid, and then further repeatedly washed with a large excess amount of pure water, whereby the content of K and Na ions and that of Mg and Ca ions in the polymer were lowered to at most about 10 ppm each. Next, the polymer was dewatered in a dewatering machine, and then well dried in vacuum at 100° C. or lower. Thus processed, the polymer had an intrinsic viscosity [η] of 1.05 dl/g (SP value=17.2). This is for the sheath component B.

On the other hand, polybutylene terephthalate copolymerized with 1.7 mol %, relative to the overall acid component of the copolymer, of 5-sodium sulfoisophthalate was prepared in an ordinary manner. Tetraisopropyl titanate was used for the polymerization catalyst, and its amount in the polymer was 35 ppm in terms of the titanium metal atom. The polymer had an intrinsic viscosity [η] of 0.85. This is for the core component A.

Conjugated in a ratio of 50:50 (by mass), the sheath component B and the core component A were spun in melt. The spinning temperature was 260° C. and the take-up speed was 3500 m/min. This gave conjugate filament yarn (83 dtex/24filaments) having the cross-section profile as in FIG. 3. The number of projections of the core component A of this conjugate fiber was 50; the ratio, $L_2/L_1$ of the outer peripheral length ($L_2$) of the core component A to the outer peripheral length ($L_1$) of the conjugate fiber was 4.5 (X/C=9.0); and the strength for the fiber was 3.1 N/dtex. Next, this was twisted to a count of 800 T/M, and knitted. The knitted fabric was dyed under the crosslinking condition and the dyeing condition mentioned below, using an ordinary jet dyeing machine. Then, this was dried and finally set in an ordinary manner. The dyed fabric was good, vivid and glossy, and core-sheath interface peeling was not found at all in the fibers. Moreover, this had a graceful good feel. The results are shown in Table 4.

Crosslinking Condition:

| | | |
|---|---|---|
| Processing agent: | | |
| 1,1,9,9-bisethylenedioxynonane | 10% | omf |
| sodium dodecylbenzenesulfonate | 0.5 | g/liter |
| maleic acid | 1 | g/liter |
| Bath ratio: | 1:50 | |
| Temperature: | 115° C. × 40 minutes | |
| Dyeing condition: | | |
| Dye: Dianix Red BN-SE (CI Disperse Red 127) | 5% | omf |
| Dispersing aid: Disper TL (by Meisei Chemical Industry) | 1 | g/liter |
| pH-controlling agent: | | |
| ammonium sulfate | 1 | g/liter |
| acetic acid (48%) | 1 | g/liter |
| Bath ratio: | 1:50 | |
| Temperature: | 115° C. × 40 minutes | |
| R ductiv washing: | | |
| Hydrosulfide | 1 | g/liter |
| Amiladin (by Daiichi Kogyo Seiyaku) | 1 | g/liter |
| NaOH | 1 | g/liter |
| Bath ratio: | 1:30 | |
| Temperature: | 80° C. × 120 minutes | |

TABLE 3

| | Sheat Component B | | Core Component A | | | | | | | | | Degree of Flatness of Conjugate Fibers |
|---|---|---|---|---|---|---|---|---|---|---|---|---|
| | degree of copolymerization with ethylene (mol %) | degree of saponification (%) | type | type of comonomer/degree of copolymerization | Conjugate Ratio (C) | Cross-Section Profile | Number of Projections | Distance between Neighboring Projections (I) | Angle (R°) | L2/L1 | (L2/L1) | |
| Example 11 | 44 | 99 | SIPcoPBT | SIP/1.7 | 0.5 | FIG. 3 | 50 | 0.35 | 80–90 | 4.5 | 9.0 | 2.3 |

TABLE 3-continued

| | Sheat Component B | | Core Component A | | Conjugate Ratio (C) | Cross-Section Profile | Number of Projections | Distance between Neighboring Projections (I) | Angle (R°) | L2/L1 | (L2/L1) | Degree of Flatness of Conjugate Fibers |
|---|---|---|---|---|---|---|---|---|---|---|---|---|
| | degree of copolymerization with ethylene (mol %) | degree of saponification (%) | type | type of comonomer/degree of copolymerization | | | | | | | | |
| 12 | 44 | 99 | SIPcoPET | SIP/1.7 | 0.5 | FIG. 3 | 50 | 0.35 | 80–90 | 4.7 | 9.4 | 2.3 |
| 13 | 44 | 99 | PET | –/– | 0.5 | FIG. 3 | 50 | 0.64 | 80–90 | 4.7 | 9.4 | 2.2 |
| 14 | 44 | 99 | IPAcoPET | IPA/4.0 | 0.5 | FIG. 3 | 30 | 0.65 | 80–90 | 3.3 | 6.6 | 2.3 |
| 15 | 44 | 99 | IPAcoPET | IPA/4.0 | 0.3 | FIG. 3 | 30 | 0.67 | 80–90 | 1.9 | 6.3 | 2.0 |
| 16 | 44 | 99 | IPAcoPET | IPA/4.0 | 0.7 | FIG. 3 | 30 | 0.61 | 80–90 | 4.3 | 6.1 | 24 |
| 17 | 44 | 99 | Ny6 | –/– | 0.5 | FIG. 3 | 30 | 0.65 | 80–90 | 3.4 | 6.8 | 2.1 |
| 18 | 44 | 99 | SIPcoPBT | SIP/1.7 | 0.5 | FIG. 4 | 30 | 0.7 | 80–90 | 2.8 | 5.6 | 1.1 |
| 19 | 44 | 99 | SIPcoPBT | SIP/1.7 | 0.5 | FIG. 5 | 30 | 0.72 | 75–90 | 1.5 | 3.0 | — |
| 20 | 44 | 99 | PP | –/– | 0.5 | FIG. 3 | 30 | 0.6 | 80–90 | 3.7 | 7.4 | 1.9 |
| 21 | 32 | 99 | IPAcoPET | IPA/4.0 | 0.5 | FIG. 3 | 50 | 0.35 | 80–90 | 4.7 | 9.4 | 2.3 |
| 22 | 56 | 99 | PET | –/– | 0.5 | FIG. 3 | 50 | 0.34 | 80–90 | 4.6 | 9.2 | 24 |
| Comp. Example 4 | 44 | 99 | SIPcoPET | SIP/1.7 | 0.5 | FIG. 9 | 0 | — | — | 0.48 | 0.96 | — |
| 5 | 44 | 99 | PET | –/– | 0.5 | FIG. 9 | 0 | — | — | 0.48 | 0.96 | — |
| 6 | 44 | 99 | PET | –/– | 0.5 | FIG. 9 | 3 | — | — | 0.55 | 1.1 | — |
| 7 | 44 | 99 | Ny6 | –/– | 0.5 | FIG. 9 | 0 | — | — | 0.49 | 0.98 | — |
| 8 | 44 | 99 | PP | –/– | 0.5 | FIG. 9 | 0 | — | — | 0.60 | 1.2 | — |
| 9 | 32 | 99 | IPAcoPET | IPA/4.0 | 0.5 | FIG. 9 | 0 | — | — | 0.48 | 0.96 | — |
| 10 | 56 | 99 | PET | *–/– | 0.5 | FIG. 9 | 0 | — | — | 0.48 | 0.96 | — |

SIPcoPBT: 5-sodium sulfoisophthalate-copolymerized polybutylene terephthalate Ny6: nylon 6
SIPcoPET: 5-sodium sulfoisophthalate-copolymerized polyethylene terephthalate, PP: polypropylene
IPAcoPET; isophthalic acid-copolymerized polyethylene terephthalate, PET: polyethylene terephthalate

TABLE 4

| | Evaluation Results | | | |
|---|---|---|---|---|
| | Fiber Productivity | Interface Peeling Resistance | Feel Evaluation | Total Evaluation |
| Example 11 | ○○ | ○○ | Vivid and glossy. Good feel with graceful dry tough. | ○○ |
| 12 | ○ | ○○ | Vivid and glossy. Good feel with graceful dry tough. | ○ to ○○ |
| 13 | ○ to ○○ | ○○ | Vivid and glossy. Good feel with graceful dry tough. | ○ to ○○ |
| 14 | ○○ | ○ to ○○ | Vivid and glossy. Good feel with graceful dry tough. | ○ to ○○ |
| 15 | ○○ | ○ to ○○ | Vivid and glossy. Good feel with graceful dry tough. | ○ to ○○ |
| 16 | ○○ | ○ to ○○ | Vivid and glossy. Good feel with graceful dry tough. | ○ to ○○ |
| 17 | ○○ | ○○ | Vivid and glossy. Good feel with graceful dry tough. | ○○ |
| 18 | ○ to ○○ | ○○ | Vivid and glossy. Good feel with graceful dry tough. | ○ to ○○ |
| 19 | ○ to ○○ | ○○ | Vivid and glossy. Good feel with graceful dry tough. | ○ to ○○ |
| 20 | ○○ | ○ to ○○ | Good feel for wet nonwoven fabric. | ○ to ○○ |
| 21 | ○ to ○○ | ○ to ○○ | Vivid and glossy. Good feel with graceful dry tough. | ○ to ○○ |
| 22 | ○○ | ○ to ○○ | Vivid and glossy. Good feel with graceful dry tough. | ○ to ○○ |
| Comp. Example 4 | ○ to ○○ | Δ to x | Vivid and good feel, but many friction marks seen owing to the interface peeling in the fibers. This is unsuitable to outer wear. | Δ to x |

TABLE 4-continued

| | Evaluation Results | | | |
|---|---|---|---|---|
| | Fiber Productivity | Interface Peeling Resistance | Feel Evaluation | Total Evaluation |
| 5 | ○ to ○○ | x | Vivid and good feel, but many friction marks seen owing to the interface peeling in the fibers. This is unsuitable to outer wear. | x |
| 6 | ○ to ○○ | Δ to x | Vivid and good feel, but many friction marks seen owing to the interface peeling in the fibers. This is unsuitable to outer wear. | Δ to x |
| 7 | ○○ | Δ to x | Vivid and good feel, but many friction marks seen owing to the interface peeling in the fibers. This is unsuitable to outer wear. | Δ to x |
| 8 | ○ to ○○ | Δ to x | Much interface peeling seen and the quality is bad. | Δ to x |
| 9 | ○ to ○○ | x | Same as Comparative Example 4. | x |
| 10 | ○○ | x | " | x |

Examples 12 to 17

Fibers were produced in the same manner as in Example 11, except that the core component A, the conjugate ratio and the number of projections were changed as in Table 3. The interface peeling resistance test result and the feel test result are shown in Table 4. All the fibers had good productivity, and their interface peeling resistance and feel were both good.

Examples 18, 19

Fibers were produced in the same manner as in Example 11, except that the cross-section profile was changed to FIG. 4 and FIG. 5. The interface peeling resistance and the feel of the fibers were both good.

Example 20

Conjugate fibers were produced in the same manner as in Example 11, except that the core component A was polypropylene. These were cut into 5 mm pieces, formed into a nonwoven fabric and passed through a roll calender at 110° C., according to an ordinary wet papermaking process. Its productivity was good, and the nonwoven fabric obtained had good texture quality.

Examples 21, 22

Fibers were produced in the same manner as in Example 11, except that the degree of copolymerization with ethylene for the sheath component B was changed as in Table 3. The interface peeling resistance and the feel of the fibers were both good.

Comparative Examples 4 to 7

Fibers were produced in the same manner as in Example 11, except that the core component A, the cross-section profile and the number of projections of the component A were changed as in Table 3. The fibers all had a good feel, but many friction marks were seen in the fabric owing to the core/sheath interface peeling in the fibers. The quality of the fabric is low and is not on the practical level.

Comparative Example 8

Using polypropylene for the core component A, fibers were produced in the same manner as in Example 20. These were cut into 5 mm pieces, and formed into a nonwoven fabric by wet process. However, in the process of working them, the core/sheath peeling occurred frequently in the fibers, and the quality of the fabric was extremely bad.

Comparative Examples 9, 10

Fibers were produced in the same manner as in Example 11, except that the degree of copolymerization with ethylene for the sheath component B was varied as in Table 3. Many friction marks were seen in the fabric owing to the core/sheath interface peeling in the fibers, and the quality of the fabric was low.

Example 23

The saponified ethylene-vinyl acetate copolymer that had been prepared in Example 11 was used as a polymer for the sheath component B. The polybutylene terephthalate copolymerized with 1.7 mol %, relative to the overall acid component of th copolymer, of 5-sodium sulfoisophthalate that had been prepared also in Example 11 was combined with a specific amount of inorganic particles as in Table 5, and this was sued as a copolymer for the core component A. Conjugated in a ratio of 50:50 (by mass), the sheath component B and the core component A were spun in melt. The spinning temperature was 260° C., and the take-up speed was 3500 m/min. This gave conjugate filament yarn (83 dtex/24 filaments) having the cross-section profile as in FIG. 6. The number of the core components A (L/D=6.0) of this conjugate fiber was 50; and the mean distance between the neighboring projections was 0.33 $\mu$m. The ratio ($L_2/L_1$) of the overall outer peripheral length ($L_2$) of the core components to the outer peripheral length ($L_1$) of the conjugate fiber was 5.0 (X/C=10.0); and the strength of the fiber was 3.1 N/dtex. Next, this was twisted to a count of 800 T/M, and knitted. The knitted fabric was crosslinked and dyed in the same manner as in Example 11. Then, this was dried and finally set in an ordinary manner. The dyed fabric was good, vivid and glossy, and core-sheath interface peeling was not found at all in the fibers. Moreover, this had a graceful good feel. The results are shown in Table 6.

TABLE 5

Figure 6:
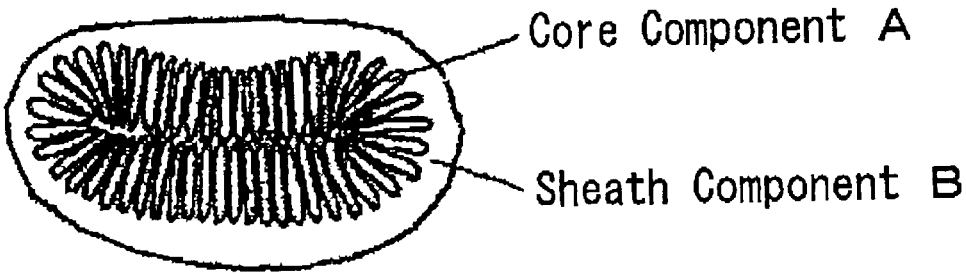
Figure 7:
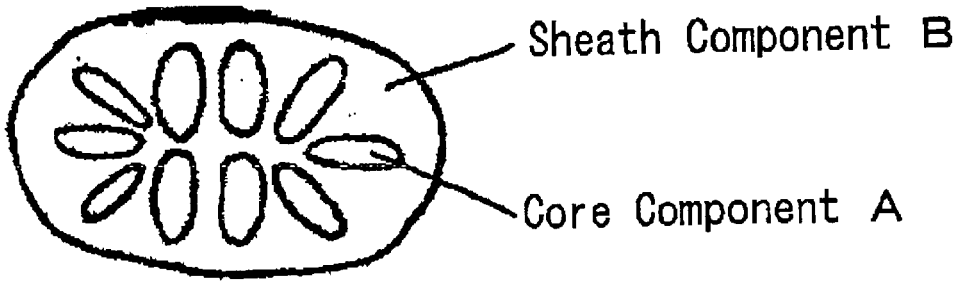
Figure 8:
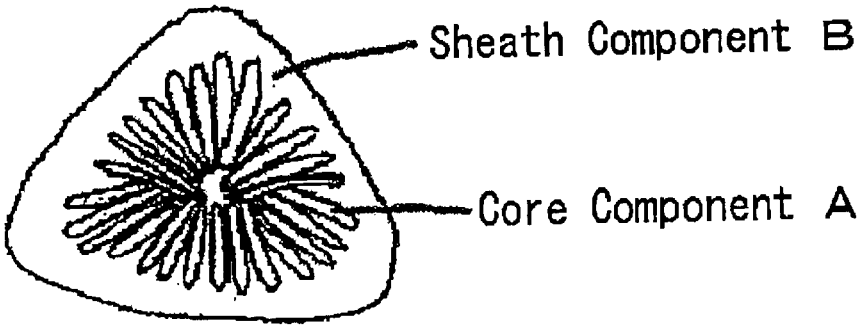

| | Sheath Component B | | Core Component A | | | | | | | | | | | | |
|---|---|---|---|---|---|---|---|---|---|---|---|---|---|---|---|
| | degree of co-poly-meri-zation with ethylene (mol %) | degree of saponi-fica-tion (%) | type | type of como-nomer degree of co-poly-meri-zation (mol %) | Inorganic Particles type | primary particle size (μm) | amount added (% by mass) | Conju-gate Ratio of Core Com-ponent (C) | Cross-Section Profile | Degree of Flat-ness of Conju-gate Fiber | Num-ber of Core Com-po-nents | Degree of Flat-ness of Core Com-po-nents L/D | Dis-tance be-tween Neigh-bor-ing Core Com-po-nents (I) | Angle (R°) | (L2/L1) C |
| Ex. 23 | 44 | 99 | SIPcoPBT | SIP/1.7 | $TiO_2$ | 0.3 | 0.05 | 0.5 | FIG. 6 | 1.9 | 50 | 6 | 0.33 | 80–90 | 10.0 |
| 24 | 44 | 99 | SIPcoPET | SIP/1.7 | $TiO_2$ | 0.3 | 0.45 | 0.5 | FIG. 6 | 1.8 | 50 | 6 | 0.3 | 80–90 | 9.8 |
| 25 | 44 | 99 | PET | –/– | silica | 0.045 | 2.5 | 0.5 | FIG. 6 | 1.9 | 50 | 6 | 0.3 | 80–90 | 9.8 |
| 26 | 44 | 99 | IPAcoPET | IPA/4.0 | silica | 0.045 | 1.0 | 0.5 | FIG. 6 | 1.6 | 30 | 4 | 0.58 | 80–90 | 7.0 |
| 27 | 44 | 99 | IPAcoPET | IPA/4.0 | $TiO_2$ | 0.3 | 0.045 | 0.3 | FIG. 6 | 1.6 | 30 | 4 | 0.56 | 80–90 | 6.7 |
| 28 | 44 | 99 | IPAcoPET | IPA/4.0 | $TiO_2$ | 0.3 | 0.45 | 0.7 | FIG. 6 | 1.5 | 30 | 4 | 0.59 | 80–90 | 6.5 |
| 29 | 44 | 99 | Ny6 | –/– | — | — | — | 0.5 | FIG. 6 | 1.7 | 30 | 3.8 | 0.59 | 80–90 | 7.2 |
| 30 | 44 | 99 | SIPcoPBT | SIP/1.7 | $TiO_2$ | 0.3 | 0.05 | 0.5 | FIG. 7 | 1.4 | 10 | 4 | 0.61 | 80–90 | 2.4 |
| 31 | 44 | 99 | SIPcoPBT | SIP/1.7 | $TiO_2$ | 0.3 | 0.05 | 0.5 | FIG. 8 | 1.4 | 30 | 4 | 0.58 | 75–90 | 5.4 |
| 32 | 44 | 99 | PP | –/– | — | — | — | 0.5 | FIG. 6 | 1.2 | 30 | 4.3 | 0.57 | 80–90 | 7.8 |
| 33 | 32 | 99 | IPAcoPET | IPA/4.0 | $TiO_2$ | 0.3 | 3.5 | 0.5 | FIG. 6 | 1.9 | 50 | 6 | 0.6 | 80–90 | 9.8 |
| 34 | 35 | 99 | PET | –/– | $TiO_2$ | 0.3 | 3.5 | 0.5 | FIG. 6 | 1.8 | 50 | 6 | 0.6 | 80–90 | 9.8 |
| Co. Ex. 11 | 44 | 99 | SIPcoPBT | SIP/1.7 | $TiO_2$ | 0.3 | 0.05 | 0.5 | FIG. 9 | 1 | 1 (core/sheath) | — | — | — | 1.2 |
| 12 | 44 | 99 | PET | –/– | $TiO_2$ | 0.3 | 0.05 | 0.5 | FIG. 9 | 1 | 1 (core/sheath) | — | — | — | 1.0 |
| 13 | 44 | 99 | Ny6 | –/– | — | — | — | 0.5 | FIG. 9 | 1 | 1 (core/sheath) | — | — | — | 1.5 |
| 14 | 44 | 99 | PET | –/– | $TiO_2$ | 0.3 | 0.45 | 0.5 | FIG. 10 | 1.1 | 4 | — | — | — | 1.2 |
| 15 | 44 | 99 | PP | –/– | — | — | — | 0.5 | FIG. 9 | 1 | 1 (core/sheath) | — | — | — | 1.4 |
| 16 | 32 | 99 | IPAcoPET | IPA/4.0 | $TiO_2$ | 0.3 | 0.45 | 0.5 | FIG. 9 | 1 | 1 (core/sheath) | — | — | — | 1.0 |
| 17 | 56 | 99 | PET | –/– | $TiO_2$ | 0.3 | 0.45 | 0.5 | FIG. 9 | 1 | 1 (core/sheath) | — | — | — | 1.0 |

SIPcoPBT: 5-sodium sulfolsophthalate-copolymerized polyethylene trerphthalate, Ny6: nylon 6
SIPcoPBT: 5-sodium sulfolsophthatate-copolymerized polyethtlene terephthalate, PP: polypropylene
IPAcoPET: isophthalic acid-copolymerized polyethylene terephthalate, PET: polyethylene terephthalate

TABLE 6

| | Evaluation Results | | | |
|---|---|---|---|---|
| | Fiber Productivity | Interface Peeling Resistance | Feel Evaluation | Total Evaluation |
| Example 23 | ○○ | ○○ | Vivid and glossy. Good feel with graceful dry tough. | ○○ |
| 24 | ○ | ○○ | Vivid and glossy. Good feel with graceful dry tough. | ○ to ○○ |
| 25 | ○ to ○○ | ○○ | Vivid and glossy. Good feel with graceful dry tough. | ○ to ○○ |
| 26 | ○○ | ○ to ○○ | Vivid and glossy. Good feel with graceful dry tough. | ○ to ○○ |
| 27 | ○○ | ○ to ○○ | Vivid and glossy. Good feel with graceful dry tough. | ○ to ○○ |
| 28 | ○○ | ○ to ○○ | Vivid and glossy. Good feel with graceful dry tough. | ○ to ○○ |
| 29 | ○○ | ○○ | Vivid and glossy. Good feel with graceful dry tough. | ○○ |
| 30 | ○ to ○○ | ○○ | Vivid and glossy. Good feel with graceful dry tough. | ○ to ○○ |

TABLE 6-continued

| | Evaluation Results | | | |
|---|---|---|---|---|
| | Fiber Productivity | Interface Peeling Resistance | Feel Evaluation | Total Evaluation |
| 31 | ○ to ○○ | ○○ | Vivid and glossy. Good feel with graceful dry tough. | ○ to ○○ |
| 32 | ○○ | ○ to ○○ | Good feel for wet nonwoven fabric. | ○ to ○○ |
| 33 | ○ to ○○ | ○ to ○○ | Vivid and glossy. Good feel with graceful dry tough. | ○ to ○○ |
| 34 | ○○ | ○ to ○○ | Vivid and glossy. Good feel with graceful dry tough. | ○ to ○○ |
| Comp. Ex. 11 | ○ to ○○ | Δ to x | Vivid and good feel, but many friction marks seen owing to the interface peeling in the fibers. This is unsuitable to outer wear. | ○ to ○○ |
| 12 | ○ to ○○ | x | Vivid and good feel, but many friction marks seen owing to the interface peeling in the fibers. This is unsuitable to outer wear. | x |
| 13 | ○ to ○○ | Δ to x | Vivid and good feel, but many friction marks seen owing to the interface peeling in the fibers. This is unsuitable to outer wear. | Δ to x |
| 14 | ○○ | Δ to x | Vivid and good feel, but many friction marks seen owing to the interface peeling in the fibers. This is unsuitable to outer wear. | Δ to x |
| 15 | ○ to ○○ | Δ to x | Much interface peeling seen, and the quality is bad. | Δ to x |
| 16 | ○ to ○○ | x | Same as Comparative Example 11. | x |
| 17 | ○○ | x | " | x |

Examples 24 to 29

Fibers were produced in the same manner as in Example 23, except that the core component A, the conjugate ratio and the number of cores were changed as in Table 5. The interface peeling resistance test result and the feel test result are shown in Table 6. All the fibers had good productivity, and their interface peeling resistance and feel were both good.

Examples 30, 31

Fibers were produced in the same manner as in Example 23, except that the cross-section profile was changed to FIG. 7 and FIG. 8. The interface peeling resistance and the feel of the fibers were both good.

Example 32

Conjugate fibers were produced in the same manner as in Example 23, except that the core component A was polypropylene. These were cut into 5 mm pieces, formed into a nonwoven fabric and passed through a roll calender at 110° C., according to an ordinary wet papermaking process. Its productivity was good, and the nonwoven fabric obtained had good texture quality.

Examples 33, 34

Fibers were produced in the same manner as in Example 23, except that the degree of copolymerization with ethylene for the sheath component B was changed as in Table 5. Th interface peeling resistance and the feel of the fibers were both good.

Comparative Examples 11 to 13

Figure 9:
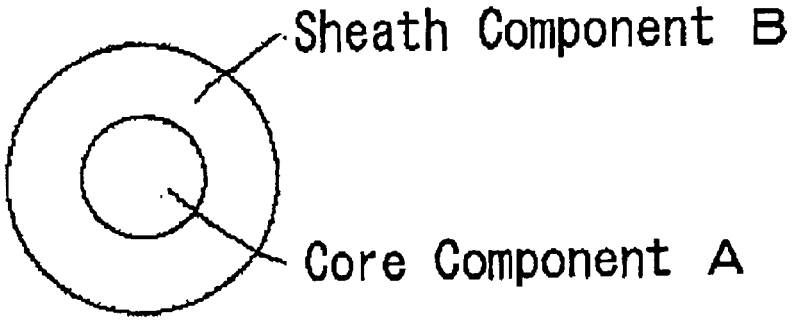
FIGS. 9 and 10 are schematic views showing examples of the conjugated cross section of fibers outside the invention.
Figure 10:
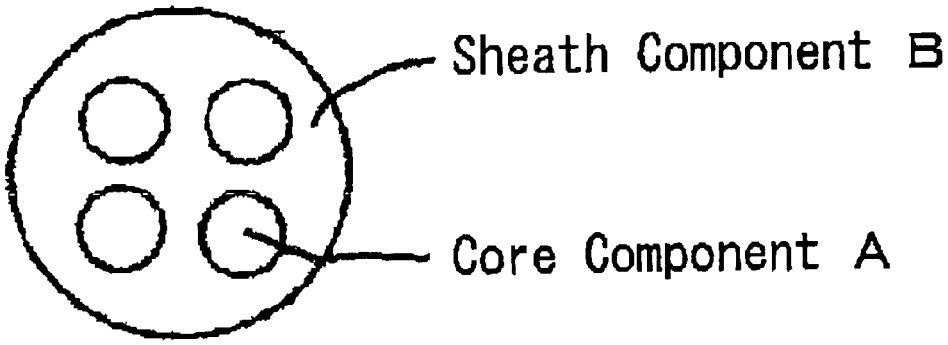

Fibers were produced in the same manner as in Example 23, except that the core component A and the cross-section profile were changed to core/sheath forms as in FIG. 9. The fibers all had a good feel, but many friction marks were seen in the fabric owing to the core/sheath interface peeling in the fibers. The quality of the fabric is low and is not on the practical level.

Comparative Example 14

Fibers were produced in the same manner as in Example 23, except that the conjugate ratio and the number of islands were changed as in Table 5. Those satisfying both the fiber productivity and the interface peeling resistance could not be obtained.

Comparative Example 15

Using polypropylene for the core component A, fibers were produced in the same manner as in Example 32. These were cut into 5 mm pieces, and formed into a nonwoven fabric by wet process. However, in the process of working them, the core/sheath peeling occurred frequently in the fibers, and the quality of the fabric was extremely bad.

Comparative Examples 16, 17

Fibers were produced in the same manner as in Example 23, except that the degree of copolymerization with ethylene for the sheath component B was varied as in Table 5. Many friction marks were seen in the fabric owing to the core/sheath interface peeling in the fibers, and the quality of the fabric was low.

INDUSTRIAL APPLICABILITY

The conjugate fibers of the invention have the advantages of good workability, resistance to core/sheath peeling, deep colorability to give colored articles and good feel, and are favorable for clothing. Not only for clothing, the fibers are also favorable for non-clothing such as living materials and industrial materials. Contrary to conventional synthetic fibers, the conjugate fibers of the invention are highly hydrophilic and have good colorability and glossiness, in addition, they have a soft and natural fiber-like feel, and their interface peeling resistance is good. The invention provides fibrous products of such good conjugate fibers.

What is claimed is:

1. A core/sheath conjugate fiber comprising a core component A of a thermoplastic polymer and a sheath component B of another thermoplastic polymer, which is characterized in that in its cross section, the core component A has at least 25 projections or exists as an aligned group of at least 25 flattened cross-section core components, the distance (I) between the neighboring projections or between the neighboring flattened cross-section core components is at most 1.5 m, the projections or the flattened cross-section core components are so positioned that their major axes are all at an angle of 90°±15° to the outer periphery of the fiber cross section, and the ratio (X) of the outer peripheral length ($L_2$) of the core component A to the outer peripheral length ($L_1$) of the conjugate fiber satisfies the following formula (1):

$$X/C \geqq 2 \quad (1)$$

wherein X indicates the ratio of the outer peripheral length of the core component A to the outer peripheral length of the conjugate fiber ($L_2/L_1$); and C indicates the conjugate ratio by mass of the core component A to the overall conjugate fiber defined as 1.

2. The conjugate fiber as claimed in claim 1, wherein the conjugate ratio (% by mass) of the core component A to the sheath component B falls between 10:90 and 90:10.

3. The conjugate fiber as claimed in claim 1, wherein the thermoplastic polymer to form the core component A is immiscible with the thermoplastic polymer to form the sheath component B.

4. The conjugate fiber as claimed in claim 1 wherein the sheath component B is an ethylene-vinyl alcohol copolymer having an ethylene content of from 25 to 70 mol %, and the core component A is a thermoplastic polymer having a melting point of not lower than 160° C.

5. The conjugate fiber as claimed in claim 1 of which the degree of flatness falls between 1.5 and 5.0.

6. The conjugate fiber as claimed in claim 1 wherein the core component A contains inorganic particles and the primary mean particle size (μm) of the inorganic particles and the content (% by mass) of the inorganic particles satisfy the following formulae (2) to (4):

$$0.01 \leqq \text{primary mean particle size}(\mu m) \leqq 5.0 \quad (2)$$

$$0.05 \leqq \text{content of inorganic particles (\% by mass)} \leqq 10.0 \quad (3)$$

$$0.01 \leqq Y \leqq 3.0 \quad (4)$$

wherein Y=primary mean particle size (μm)×content of inorganic particles (% by mass).

* * * * *